US007903830B2

(12) United States Patent
Hansen et al.

(10) Patent No.: US 7,903,830 B2
(45) Date of Patent: Mar. 8, 2011

(54) PUSH-PULL CAPACITIVE MICRO-MACHINED ULTRASOUND TRANSDUCER ARRAY

(75) Inventors: Sean Thomas Hansen, Sunnyvale, CA (US); Paul Anthony Wagner, Mountain View, CA (US); Stephen Roy Barnes, Bellevue, WA (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 1245 days.

(21) Appl. No.: 11/502,913

(22) Filed: Aug. 10, 2006

(65) Prior Publication Data

US 2008/0049954 A1 Feb. 28, 2008

(51) Int. Cl.
*H04R 25/00* (2006.01)

(52) U.S. Cl. ..... 381/174; 381/369

(58) Field of Classification Search ..... 381/173–176, 381/191, 369; 361/225
See application file for complete search history.

(56) References Cited

U.S. PATENT DOCUMENTS

| | | | | |
|---|---|---|---|---|
| 2,631,196 | A | 3/1953 | Janszen | |
| 4,533,794 | A * | 8/1985 | Beveridge | 381/174 |
| 2003/0118203 | A1 * | 6/2003 | Raicevich | 381/174 |

OTHER PUBLICATIONS

Frederick V. Hunt, Electroacoustics, The Analysis of Transduction, and Its Historical Background, copyright 1954 & 1982, pp. 172-212, American Institute of Physics for the Acoustical Society of America.
J. H. Streng, Charge Movements on the Stretched Membrane in Circular Electrostatic Push-Pull Loudspeaker, J. Audio Eng. Soc., vol. 38, No. 5, 1990 May, pp. 331-338, Philips Research Laboratories, The Netherlands.
Patrick De. Visschere, Accurate Model for the Push-Pull Electrostatic Loudspeaker, J. Audio Eng. Soc., vol. 43, No. 7/8, Jul./Aug. 1995, pp. 563-571, University of Gent, Department of Electronics and Information Systems, Belgium.
U.S. Appl. No. 11/051,349, filed Feb. 4, 2005, Lu et al., Multi-Dimensional Ultrasound Transducer Array.
U.S. Appl. No. 11/236,700, filed Sep. 26, 2005, Oliver et al., 3-1 Mode Capacitive Membrane Ultrasound Transducer.

* cited by examiner

*Primary Examiner* — Suhan Ni

(57) ABSTRACT

A push-pull capacitive micromechanical ultrasound transducer (CMUT) is provided for ultrasound imaging or therapy. Gaps and electrodes on both sides of an electrostatic membrane provide push-pull operation. The membrane is oriented to flex in a direction of acoustic propagation. A surface connected to the membrane may better expose the movement to the acoustic medium even in the push-pull arrangement.

17 Claims, 7 Drawing Sheets

PUSH-PULL CAPACITIVE MICRO-MACHINED ULTRASOUND TRANSDUCER ARRAY

BACKGROUND

The present embodiments relate to electrostatic transducers (i.e., capacitive micro-machined ultrasound transducers (CMUTs)).

An element of a CMUT transduces between electrical and acoustic energy. The element includes a plurality of membranes 12 (see FIG. 1) formed on a silicon substrate 14. Each membrane 12 is adjacent a single gap 16. An electrode is adjacent to the membrane 12, and another electrode is on the other side of the single gap 16. A DC voltage applied to the electrode adjacent the membrane 12 biases the membrane 12. Variation in electrical potential between the electrodes causes the membrane 12 to flex into and out of the gap 16. The flexing generates acoustic energy. Acoustic reflections cause the membrane 12 to flex, causing variation in electrical potential.

The force on the membrane 12 may be represented by:

$$F = \frac{\varepsilon_0 \cdot \text{Area} \cdot (V_{dc} + V_{ac})^2}{2(d-w)^2},$$

where $V_{dc}$ is the DC bias voltage, $\epsilon_0$ is a constant representing the permittivity of free space, $V_{ac}$ is the AC voltage signal, d is an initial gap or separation, and w is the AC displacement from an equilibrium position. The membrane displacement, which determines the output pressure, responds proportionally to the force at low frequencies. An estimate of nonlinear distortion is possible by analyzing the equation above for electrostatic force. The voltage-squared term in the numerator dominates the nonlinear distortion since the AC displacement, w, is usually much smaller than the total gap distance, d. Second harmonics are generated, and are roughly proportional to the ratio of $V_{ac}/V_{dc}$ for small AC displacements (i.e., w<<d). Second harmonics generated by a transducer may be undesired, especially in imaging modes that attempt to isolate $2^{nd}$ harmonics generated in tissue or by contrast agent microbubbles. CMUTs designed for high pressure output can have AC displacements that are significant fractions of the nominal gap thickness. In this case, there will be additional nonlinear terms that produce both even and odd harmonics.

As the membrane 12 deflects and the spacing between capacitor plates (i.e., electrodes) reduces, the electrostatic force increases. At some amount of displacement, the electrostatic force overwhelms the restoring spring force of the membrane 12, causing the membrane to contact the substrate and hindering further movement. When parallel, rigid plates are assumed with a linear membrane restoring force, this distance is about ⅓ of the moveable gap 16 at low frequencies. This often restricts the maximum DC bias voltage and AC drive voltages that can be applied to the CMUT.

BRIEF SUMMARY

By way of introduction, the preferred embodiments described below include methods, transducers, elements and systems for electrostatic transduction. Gaps and electrodes on both sides of a membrane provide push-pull operation. Since electrostatic force is attractive, the use of "push" in "push-pull" herein represents the AC voltage configuration so that one electrode supplies a reduction in force while the other electrode supplies an increase in force on the membrane, with some components of the forces acting in opposite directions on the membrane. The membrane is oriented to flex or move in a direction of acoustic propagation. A surface connected to the membrane may better expose the movement to the acoustic medium in the push-pull arrangement. The surface may be used for push-pull operation without requiring electrodes on opposite sides of the membrane.

In a first aspect, a capacitive micro-machined ultrasound transducer element is provided. A membrane is operable to flex at ultrasound frequencies. A first electrode is associated with the membrane. A first gap is on a first side of the membrane. A second electrode is opposite the first gap from the membrane. A second gap is on a second side of the membrane. The second side is opposite the first side of the membrane. A third electrode is opposite the second gap from the membrane. The membrane is operable to flex in a direction substantially parallel to a direction of acoustic propagation generated by the flexing.

In a second aspect, a method is provided for transducing between electrical and ultrasound energies. Ultrasound energy is generated with an electrostatic membrane in a push-pull arrangement in response to flexing of the membrane generally facing a medium to be scanned. Electrical energy is generated with the electrostatic membrane in the push-pull arrangement.

In a third embodiment, a capacitive micro-machined ultrasound transducer array has a plurality of elements. Each element has a membrane with a membrane electrode, a substrate with a substrate electrode, and a gap between the membrane and the substrate. An improvement includes an additional electrode separated from the membrane by an additional gap in each element. The additional electrode and the additional gap are on an opposite side of the membrane than the gap and substrate electrode. The membrane is substantially orthogonal to a direction of acoustic propagation from the transducer.

In a fourth aspect, a capacitive micro-machined ultrasound transducer element is provided. A membrane is operable to move at ultrasound frequencies. A surface is spaced from and connected with the membrane. A structure extends at least partially between the membrane and the surface. A first electrode is associated with the membrane and the surface. Second and third electrodes are on opposite sides of the structure. The second electrode is adjacent to the membrane across a first gap, and the third electrode is adjacent the surface across a second gap.

The present invention is defined by the following claims, and nothing in this section should be taken as a limitation on those claims. Further aspects and advantages of the invention are discussed below in conjunction with the preferred embodiments and may be later claimed independently or in combination.

BRIEF DESCRIPTION OF THE DRAWINGS

The components and the figures are not necessarily to scale, emphasis instead being placed upon illustrating the principles of the invention. Moreover, in the figures, like reference numerals designate corresponding parts throughout the different views.

DETAILED DESCRIPTION OF THE DRAWINGS AND PRESENTLY PREFERRED EMBODIMENTS

Figure 1:
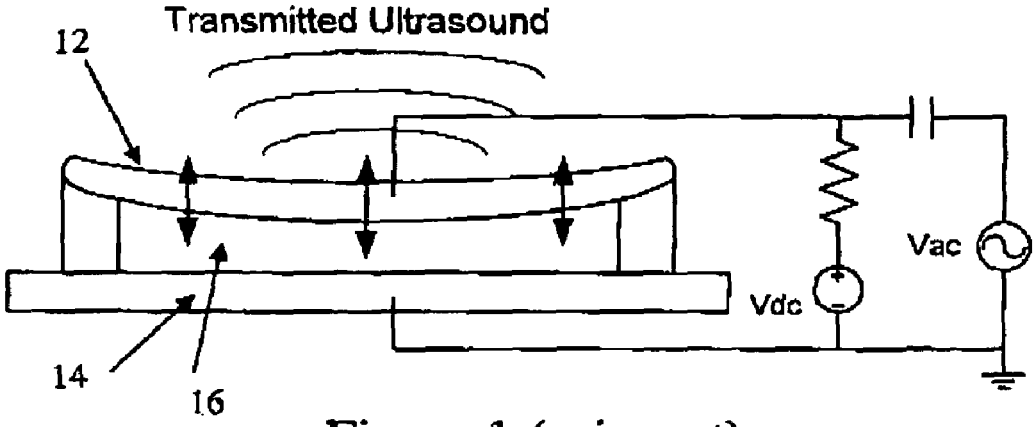
Figure 1 (prior art)
FIG. 1 is a graphical representation of a prior art electrostatic transducer.

Electrostatic actuation of CMUT transducers with a single gap for a membrane produces harmonic distortion due to nonlinearities. The nonlinear distortion may be reduced by using a push-pull actuation scheme in which a moving conductor between two driven plates experiences a simultaneous repulsive (push) force and an attractive (pull) force. The membrane motion is substantially parallel to the direction of acoustic propagation.

In tissue harmonic imaging (THI), the output signal from the transducer may be more effective if very little frequency content is generated at the harmonic frequency. The receiving transducer may detect harmonic signals generated by the tissue rather than the transmitting transducer. A push-pull CMUT may provide more effective harmonic imaging.

Push-pull operation may allow an increase in output pressures. For example, THI relies on nonlinear propagation and reflection, so the harmonic information may be weak as compared to the transmitted information. For sufficient signal-to-noise ratio, higher transmit pressures are desired. Transducers capable of producing high output pressures during transmit may generate greater harmonic signals within the tissue. With single gap CMUTs, obtaining high output pressure with low harmonic distortion are competing or conflicting objectives. The electrostatic force between two plates is proportional to the square of the voltage (or similarly, the electric field) between them. Large ratios of AC to DC voltages (or equivalently electric fields) required for high output pressure increase the levels of harmonic distortion. Push-pull operation may provide more effective THI. A push-pull design may mitigate the harmonic distortion in transmit operation by canceling the voltage-squared terms for the electrostatic force on the membranes, making the electrostatic force on the moving membrane plate almost linearly related to the driving voltage signal. In addition, the displacement of the moving member of the push-pull electrostatic transducer may be stable over a wider range of travel.

In one embodiment, a top surface of the moving structure component is exposed to the acoustic medium. An "I-beam" membrane structure allows the placement of conductive plates on either side of the moving conductor while still exposing a large area of the moving structure to the acoustic medium. Ultrasound may be transmitted in the direction of motion of the membrane. Other embodiments may be provided with or without the "I-beam" structure or the top surface.

A capacitive micro-machined ultrasound transducer (CMUT) array has a plurality of elements. The elements are arranged as a one-dimensional, two-dimensional, or other multi-dimensional array. The CMUT is formed using CMOS, micro-electro mechanical processes or other semiconductor manufacturing processes. For example, deposition, sputtering, plating, etching, printing, patterning, wafer bonding, sacrificial etching, or other now known or later developed processes form the micro-structures and/or electrical structures.

Figure 2:
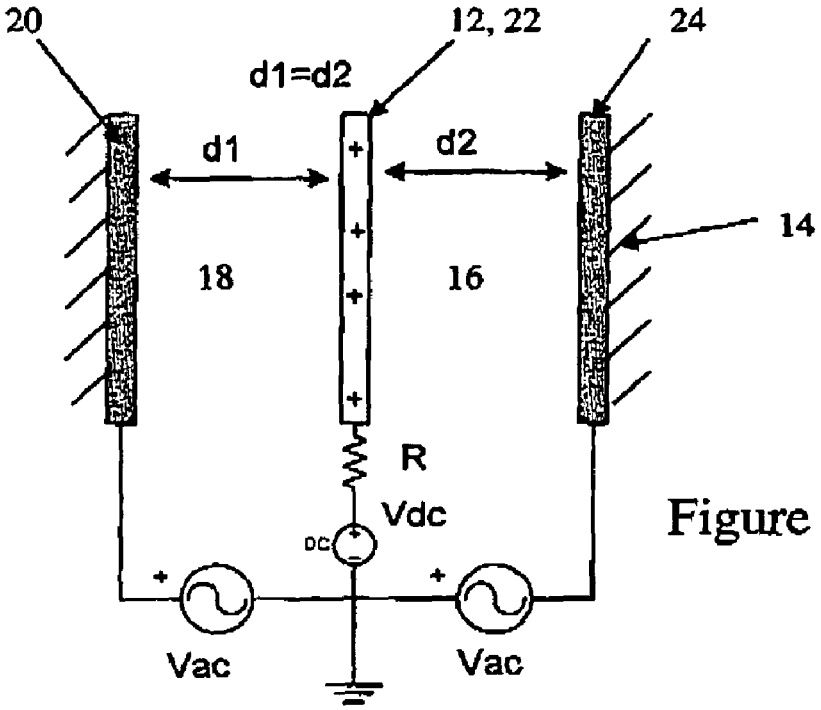
FIG. 2 is a graphical representation of one embodiment of a push-pull arrangement.

Each element has a plurality of membranes, such as tens, hundreds or thousands of membranes. FIG. 2 shows one graphic representation of a bi-directional driving configuration representing a portion of membrane structure for a CMUT element. The element includes an electrode 22 associated with a membrane 12, an electrode 24 associated with a substrate 14, a gap 16 between the membrane electrode 22 and the substrate electrode 24, an additional electrode 20, and an additional gap 18 between the membrane electrode 22 and the additional electrode 20. Additional, different or fewer components may be provided.

The substrate 14 is silicon, but other materials may be used. The substrate 14 is processed to form the membrane 12 and gaps 16, 18. The membrane 12 may be deposited on the substrate 14 with subsequent etching away of material to form the gaps 16, 18. The membrane 12 may be formed in the substrate 14 by etching away material to form the gaps 16, 18. The membrane 12 is semiconductor material or other deposited or grown material, such as silicon nitride or wafer bonded silicon. The thickness, material and size of the membrane 12 provide a desired or sufficient stiffness. The gaps 16, 18 have sufficient depth to avoid undesired or provide desired "bottoming out" of the membrane 12 during operation with a DC bias voltage.

The electrodes 20, 22, 24 are conductive materials, such as metal or doped silicon. For example, the electrodes 20, 22, 24 are deposited metal, such as aluminum, copper, silver or gold. As another example, the electrodes 20, 22, 24 are formed from semiconductor material. The electrodes 20, 22, 24 are each formed from the same material, but may be formed from different materials.

The electrode 22 is associated with the membrane 12. The membrane electrode 22 is formed on the membrane 12, such as depositing the electrode 22 on one or both sides of the membrane 12. The electrode 22 is immediately adjacent the membrane 12, but one or more layers of material, such as insulators, may separate the electrode 22 and the membrane 12. In another embodiment, the membrane 12 forms the electrode 22, such as the membrane 12 being electrically conductive.

The electrodes 20 and 24 are formed on opposite sides of the membrane 12 across different gaps 16, 18. The electrodes 20 and 24 are part of or in the substrate 14 or are deposited on the substrate 14. The electrodes 20 and 24 are associated with more rigid structure than the membrane 12, such as the substrate 14, thicker structures, stiffer material, or supported structures. For example, one or more stiffening ribs, honeycomb pattern, support posts, or other supports make the structure more rigid than the membrane 12. The electrodes 20 and 24 and corresponding structure are relatively fixed as compared to the membrane 12. The mass of the buried membrane 12 and beam or disk 34 may be reduced to raise potential bending mode resonances by forming small holes, voids, or using a porous material. This may create a stiff structure with low mass.

The gaps 16, 18 are on opposite sides of the membrane 12. The gaps 16, 18 have a same or different depths, d1 and d2. The gaps 16, 18 and corresponding membrane 12 may have the same or different shapes and/or dimensions. The gaps 16, 18 may connect together through one or more channels or holes or may be separate. One gap 16 is between the membrane 12 and the base substrate 14. The other gap 18 is between the membrane 12 and other material, such as the substrate 14 or deposited/grown material.

The electrode 20 and corresponding gap 18 are in addition to the gap 16 and the electrode 24 on the opposite side of the membrane 12. The membrane 12 separates or defines the two gaps 16, 18. The two gaps 16, 18 and corresponding electrodes 20, 24 apply electrostatic forces for movement of the membrane 12. The gaps 16, 18 also allow movement of the membrane 12 in response to electrical or acoustic energy.

The membrane 12 is operable to flex at ultrasound frequencies, such as being sized and shaped to resonate or flex in response to waveforms at 1-20 MHz, such as 1-10 MHz. The membrane 12, gaps 16, 18 and electrodes 20, 22, 24 are oriented relative to a face of the transducer, acoustic window, and/or the direction of acoustic propagation. In one embodiment, the membrane 12 is oriented for a 3-1 mode of operation or flexes in a direction perpendicular to a direction of propagation (see U.S. Published application Ser. No. 2007/0071272 (Ser. No. 11/236,700, file Sep. 26, 2005), the disclosure of which is incorporated herein by reference).

In other embodiments, the membrane 12 flexes or moves in a direction substantially parallel to a direction of acoustic propagation generated by the flexing. The membrane 12 moves towards or away from the electrodes 20, 24 and is generally orthogonal to a direction of acoustic propagation. The acoustic energy generated by the membrane 12 travels from the membrane 12 in the direction of movement, such as represented by the arrows in FIG. 1. The membrane 12 may be treated as a point source with the acoustic energy generally propagating in a divergent pattern (see the radiating lines of transmitted ultrasound in FIG. 1). The direction of propagation is treated as the center of the divergent pattern or is generally parallel with the motion of the membrane 12. Substantially or generally in the direction of acoustic propagation is used to account for the divergent nature of the acoustic energy.

In a push-pull design, the moveable electrode 22 is positioned between two fixed electrodes 20, 24 which are driven with voltage signals having opposite phase or polarity as shown in FIG. 2. A DC bias is placed on the center electrode 22 through a large resistor designed to keep the charge on the center electrode 22 roughly constant. The product of the resistance and the capacitance between the electrodes is large (e.g., two or three times larger) than the $(\text{frequency})^{-1}$ of the AC signal, such as the resistor being 100 M ohms or 1 G ohm. The resistor is formed in the substrate 14 or is a separate component. As an alternative to the resistor and DC bias voltage, a charge is trapped or stored and insulated on the membrane 12 during fabrication, such as provided for electrets.

The equations below have been simplified to demonstrate approximately how the second harmonic generated by the voltage-squared term disappears in push-pull operation. The actual potential on the center electrode 22 depends on the movements of charge through the bias resistor, but this effect is neglected in the simplifications below. The force on the center plate due to one fixed electrode (neglecting charge movements) is:

$$F1 = \frac{-\varepsilon_0 \cdot \text{Area} \cdot (V_{dc} - V_{ac})^2}{2(d_1 + w)^2},$$

where the positive force and positive displace w are to the right. The force on the center plate due to the other fixed electrode is:

$$F2 = \frac{\varepsilon_0 \cdot \text{Area} \cdot (V_{dc} + V_{ac})^2}{2(d_2 - w)^2}.$$

The total (sum) force is the sum of F1 and F2. If the initial spacing d1 and d2 between the fixed plates and the moving center plate are equal, such that d1=d2=d, then many quadratic terms cancel from the expression for total force. In this case, the total force on the moving electrode is roughly $F_{total} \approx 2 \cdot \epsilon_0 \cdot \text{Area} \cdot V_{dc} \cdot V_{ac}/d^2$. The total force may be proportional to the driving signal $V_{ac}$, rather than having a strong dependence on the square of the driving signal as in single gap CMUT actuation. This expression also assumes that the displacement w is small relative to the distances d1 and d2 so that the charges on the electrodes do not vary significantly.

The push-pull CMUT may become unstable at high voltages (or electric fields), as the electrostatic force overwhelms the restoring spring force. However, the maximum low-frequency voltage that can be applied to the push-pull CMUT may be approximately 30% higher than a single gap CMUT. The greater electric field allows slightly higher electric fields, increasing the electrostatic force and the obtainable output pressures from the transducer proportionally.

Figure 3:
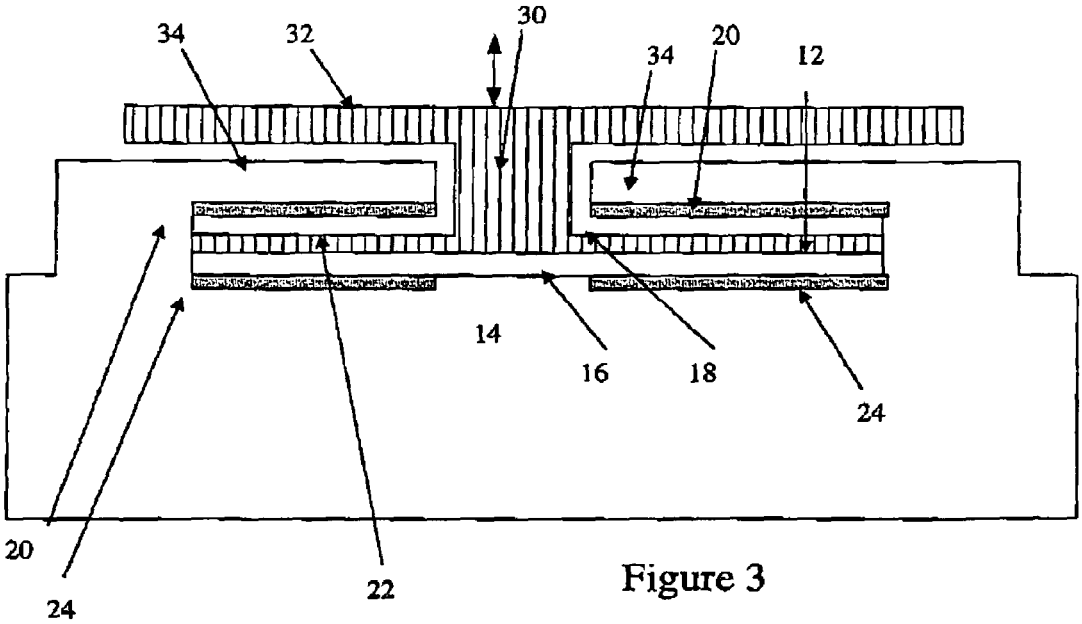
FIG. 3 is a cross-sectional view of one embodiment of a push-pull electrostatic transducer.

FIG. 3 shows a cross-section view of one embodiment of a CMUT in a push-pull arrangement. The membrane 12, substrate 14, gaps 16, 18 and electrodes 20, 22 and 24 provide push-pull operation of the transducer. The substrate electrode 24 and additional electrode 20 are each a circular disk shape with a non-conductive cutout or center, but may be divided into two or more electrically interconnected sections or may be a conductive disk with no cutout. While shown extending to the edges of the gap 16, the electrodes 20, 24 may be smaller or larger.

The membrane 12 includes the membrane electrode 22. For example, the membrane electrode 22 is deposited or formed on a bottom side of the membrane 12 as a solid disk, on the top of the membrane 12 as a disk with a cutout, or as part of the membrane 12 with any spatial extent. The membrane electrode 22 has a same or different shape and size as the substrate electrode 24 and/or additional electrode 20.

The membrane 12 connects to or is supported by the substrate 14 or another structure connected with the substrate 14. The connection is around the entire or portions of the outer edges of the membrane 12. When the membrane 12 flexes or moves, the center of the membrane 12 moves to a greater extent than the supported edges. Alternatively or additionally, other portions of the membrane 12 are supported or connected to the substrate 14.

The additional electrode 20 is formed on or in a disk or beams 34 of substrate material. Other material may be used. The disk or beams 34 are flat, but may include ribs or other supporting structures for relative rigidity. The disk or beams 34 form one or more holes, apertures, gaps or channels of any size or shape.

The membrane 12 connects, with one or more pillars 30, to a surface 32 exposable to or closer to an acoustic medium. The pillar 30 extends from the membrane 12 to the surface 32 through the one or more apertures in the disk or beams 34. As shown in an elevation, depth cross-section in FIG. 3, the membrane 12, pillar 30 and top surface 32 form an "I-beam" structure. The top surface 32 is a disk, but other shapes may be used. The top surface 32 is thicker than the membrane 12, but may be a same or thinner thickness. The top surface 32 and pillar 30 are of a same material as the membrane 12, but may be different materials. The pillar 30 is a cylinder, but may be any desired shape (e.g., cubic or plate-like). Other structures than "I-beam" may be used for transferring membrane motion to a location adjacent to the acoustic medium.

The top surface 32 moves in response to the flexing or movement of the membrane 12. The two relatively fixed electrodes 20, 24 above and below the moving membrane 12 are driven with AC voltage signals of the same or different magnitude and substantially opposite polarity. The membrane electrode 22 is DC biased or contains a fixed charge. The structural motion of the membrane 12 translates to the top surface 32, such as shown by the arrows parallel with a direction of acoustic propagation. As the membrane 12 moves up and down (i.e., towards and away from the electrodes 20, 24), the top surface 32 also moves up and down (i.e., towards and away from the acoustic medium). Because the moving membrane 12 is responsible for producing the ultrasonic pressure, exposure of the top surface 32 may provide more efficient transfer of acoustic energy. Being adjacent to the acoustic medium includes having insulating, matching, lens, and/or window layers between the top surface 32 and the acoustic medium. The top surface may be exposed to fluid (e.g., air or liquid), tissue, and/or coupling gel.

Alternatively, the membrane 12 is provided without the pillar 30 and/or the top surface 32. Acoustic energy propagates through holes in the beams or disk 34 or through substrate material enclosing the gap 18.

Figure 4:
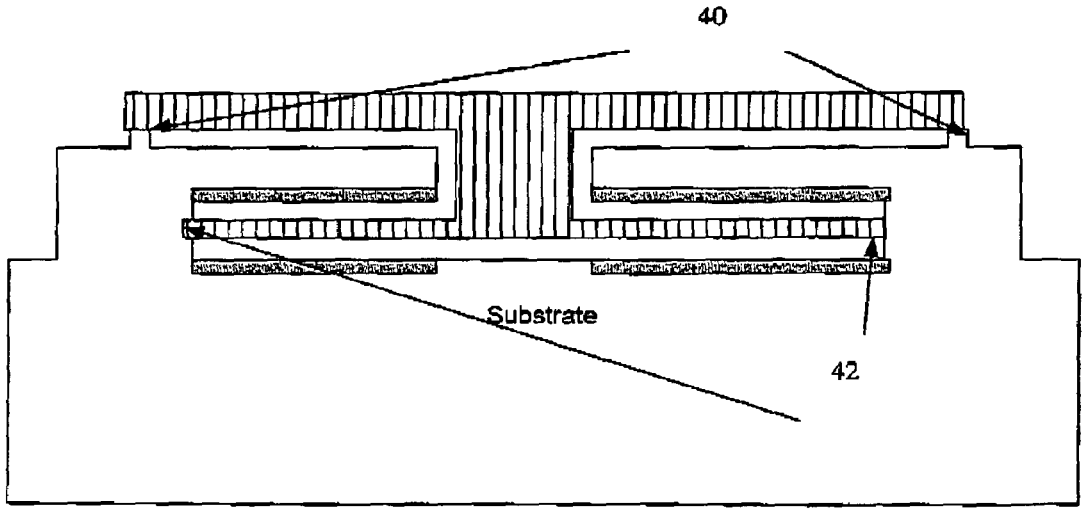
FIG. 4 is another cross-sectional view of another embodiment of a push-pull electrostatic transducer.

FIG. 4 shows an alternative embodiment of the "I-beam" arrangement. The membrane 12 connects with the substrate 14 at the edges 42. Alternatively, the membrane 12 is adjacent, slideably contacts or is spaced from the substrate 14 at the edges 42. The top surface 32 connects to the beams or disk 34, the substrate 14 or other structure. The connection is along portions or the entire circumference 40 of the top surface. For the entire circumference 40 with or without any inset, the gaps 16, 18 are sealed from contamination and squeeze-film effects that could otherwise hinder membrane motion. As the membrane 12 moves, the top surface 32 flexes or moves. The edges or circumference 40 is held in position, but the top surface 32 bows inwards and outwards. Alternatively, a bellows structure may be used to seal the gaps 16, 18 and avoid squeeze-film effects while connecting the membrane 12 and allowing the edges 40 more freedom of movement. In another alternative, no connection is provided, such as allowing the membrane 12, pillar 30 and top surface 32 to float in the substrate 14 and beams or disk 34, with the shape of the membrane 12, pillar 30 and top surface 32 relative to the substrate structure maintaining the relative position.

Figure 5:
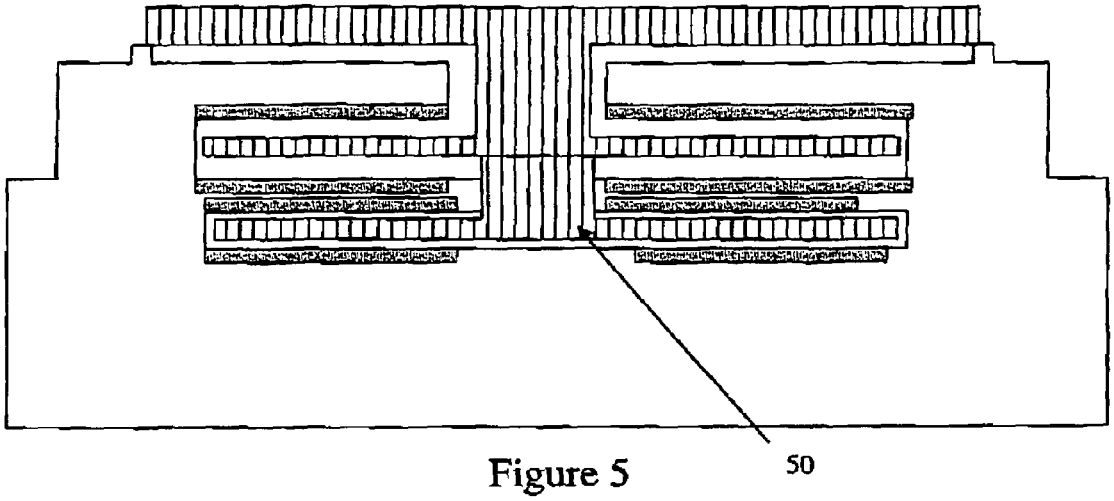
FIG. 5 is a cross-sectional view of yet another embodiment of a push-pull electrostatic transducer.

FIG. 5 shows another alternative embodiment of the "I-beam" arrangement. One or more additional membranes 50 are provided between pairs of gaps. The additional membranes 50 and corresponding gaps are stacked along the acoustic propagation direction within the substrate 14. The additional layers electrically connect in parallel. The top electrodes associated with each membrane 12, 50 electrically connect, and the bottom electrodes associated with each membrane 12, 50 electrically connect. The membrane electrodes 22 also electrically connect. Independent connections may be used, such as to apply relative phasing and/or amplitude weighting for the different layers. The disk or beams 34 for lower layer or membranes 12 include a top electrode 20 for a lower membrane 50 and a lower electrode 24 for a higher membrane.

Each membrane 12, 50 contributes to movement of the top surface 32. Additional pillars connect between the membranes 12, 50. The interconnected membranes 12, 50 apply force to the top surface 32. Two membranes 12, 50 operating with push-pull may effectively double the net force for the same applied voltages as compared to the arrangements of FIGS. 3 and 4. Additional membrane layers may form a comb-like structure in cross-section to further increase the force or lower the drive voltages. One or more layers may be associated with a single gap structure.

Push-pull operation of the CMUT provides a method for transducing between electrical and ultrasound energies. Referring to FIG. 2, a bias voltage is applied to the membrane conductor 22 (i.e., electrostatic membrane). The bias voltage is a constant voltage relative to the AC signal or ultrasound energy. The bias may vary, such as providing different levels of bias for transmit and receive operations. The bias voltage is provided through a large resistor to limit fluctuations of charge during reception or transmission events. Alternatively, a stored or trapped charge biases the membrane 12.

Ultrasound energy is generated with the electrostatic membrane 12 in the push-pull arrangement. AC voltage signals are applied with opposite phase (i.e., 180 degrees out of phase) to the electrodes 20, 24 across the gaps 16, 18 from the membrane 12. Other phases may be used, such as substantially opposite phase or other phase relationships. The AC signals for the different electrodes 20, 24 are generated by separate signal sources or beamformer channels. Alternatively, a same AC voltage source applies a signal to a center-tapped transformer. The transformer generates the AC voltage signals with the desired phase relationship for each fixed electrode 20, 24 from the single AC voltage source.

The difference in potential between the membrane electrode 22 and the substrate electrode 24 increase the attractive force ("pulls") and decreases the attractive force in the opposite direction ("pushes") on the membrane 12. The difference in potential between the membrane electrode 22 and the additional electrode 20 pulls and pushes the membrane 12. With opposite phasing, the membrane is moved in a same direction by the two potential differences. The opposite polarity or different potential across gaps 16, 18 on opposite sides of the membrane 12 cause the membrane 12 to flex or move. The electrostatic membrane 12 is pushed in a first direction and pulled in the same direction as a function of electrical energy. In response, the electrostatic membrane 12 moves. Variation in the AC signals causes variation in the movement.

In one embodiment, movement of the membrane 12 is transferred to move another structure, such as a surface 32 exposed to or closer to a medium to be scanned. The surface 32 is spaced from the membrane 12. The transfer is by direct connection, but indirect transfer may be used, such as with a gear, lever or belt. Alternatively, no transfer is provided. For example, the acoustic energy is generated by the membrane 12 without another surface 32. The energy propagates through a grid or other acoustically transparent structure holding the additional electrode 20.

The membrane 12 and/or top surface 32 (FIG. 3) face a medium to be scanned. The membrane 12 and/or top surface 32 are orthogonal to the direction of acoustic propagation, such as lying in plane on top of the substrate 14 or parallel with the top of the substrate 14 for propagation of acoustic energy away from the top of the substrate. The acoustic propagation is substantially parallel with the direction of movement or flexing of the membrane 12. Other orientations may be provided.

Electrical energy is generated with the electrostatic membrane 12 in the push-pull arrangement. As the membrane 12 moves in response to acoustic energy, variation in electrical potential is created across the gaps 16, 18. Electrical signals on opposite sides of the membrane 12 are generated by the variation. The electrical signals are processed separately, such as being amplified and/or phased separately. Alternatively, the signals are combined, such as summed by electrical connection.

In one embodiment, the received electrical energy is used as an analog signal representing the acoustic energy. Alternatively, bottoming-out or collapse of the membrane 12 against one or both gaps 16, 18 is used as a digital signal representing the acoustic energy. Different gap distances or bias levels may be used to cause different membranes 12 to collapse at different acoustic energy levels, allowing digital detection of acoustic echo amplitude.

Figure 6:
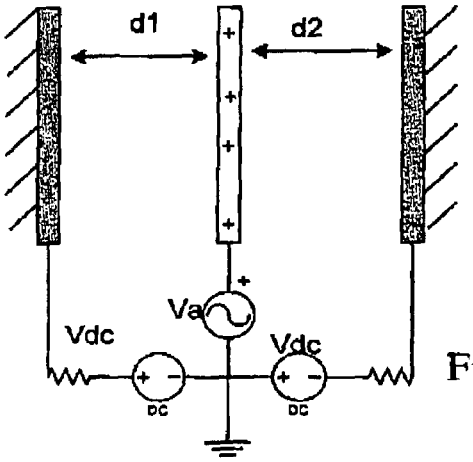
FIG. 6 is another graphical representation of another embodiment of a push-pull arrangement.

FIG. 6 shows an alternative electrical arrangement to FIG. 2. The locations of application of the AC and DC voltages are switched. The DC bias voltages and resistors are provided on the relatively fixed, substrate and additional electrodes 20, 24. The AC signal is applied to the membrane electrode 22.

FIGS. 7-11 represent a numerical simulation of a push-pull CMUT structure of FIG. 2 as compared to a single gap CMUT structure. The membrane 12 is treated as a lumped mass-spring-damper system driven by electrostatic forcing function: $m\ddot{w}+b\dot{w}+kw=F_e$, where m is the mass, b is the damping, k is the spring constant, w is the displacement, and "dot" denotes time-derivative. For the single gap CMUT, the electrostatic force is represented as:

$$F_e = \frac{\varepsilon_0 A_{el}(V_{dc} + V_{ac})^2}{2(d_1 - w)^2}$$

where $A_{el}$ is the electrode area and $d_1$ is the gap spacing.

To simplify the equations for the push-pull system, the moving membrane is assumed to be initially charged to $V_{dc}$, and then disconnected from the bias source to maintain this charge. In addition, all charge movements on the electrodes are neglected, and the membrane is assumed to move as a rigid plate. These simplifications reduce the accuracy of the simulation, but still illustrate operation of the push-pull CMUT. For the push-pull CMUT, the electrostatic force, in the case of constant charge, is given by:

$$F_e = \frac{q_1^2 - q_2^2}{2\varepsilon_0 A_{el}}$$

where the charges on the fixed electrodes #1 and #2 are given by $$q_1 = \frac{C_1 C_2}{C_1 + C_2}\left(\frac{q_0}{C_2} - 2V_{ac}\right)$$

$$q_2 = \frac{C_1 C_2}{C_1 + C_2}\left(\frac{q_0}{C_1} + 2V_{ac}\right)$$

where $q_0=q_1+q_2$ and the capacitances C1 and C2 between the center membrane and the fixed electrodes are:

$$C_1 = \frac{\varepsilon_0 A_{el}}{d_1 + w}$$

$$C_2 = \frac{\varepsilon_0 A_{el}}{d_2 - w}$$

The following values are assumed in the numerical simulations of FIGS. 7-11. Other values may be used, such as for membrane resonance at 2-8 MHz. Membrane and gap spacing parameters are: k=307.44e3 (N/m), m=5.67e-11 (kg), b=1.5e6 (kg/s), $\epsilon_0$=8.85e-12 (F/m), $A_{el}$=1539.85e-12 ($m^2$), and d1=d2=0.216e-6 (m). This membrane 12 naturally resonates at 11.7 MHz. The bias and driving voltages are: $V_{dc}$=180 (V) and AC voltage (Vac) peak amplitude of 100 (V). This value of $V_{dc}$ provides an initial total charge $q_0$ of 2.27e-11 C on the center electrode 22 of the push-pull transducer. The driving frequency is centered at 5.9 MHz, which is about half the membrane resonant frequency.

Figure 7:
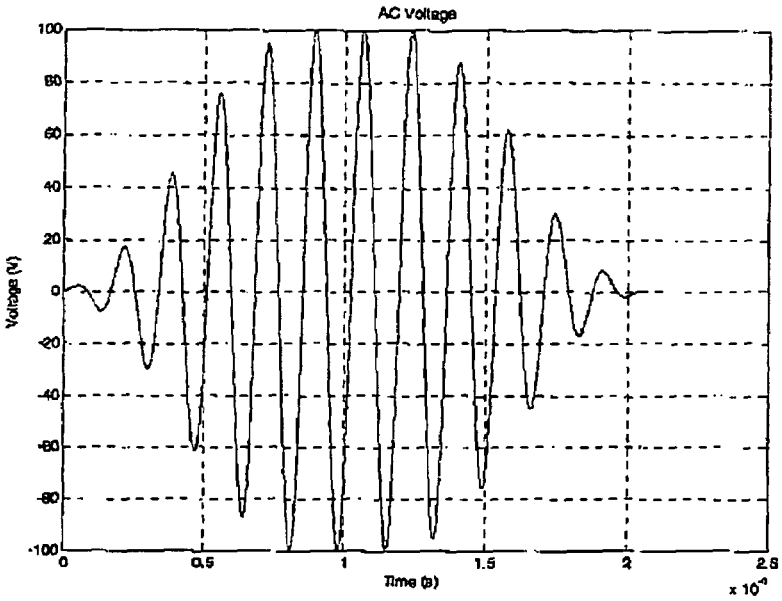
FIG. 7 is a graphical representation of one example transmit waveform.
Figure 8:
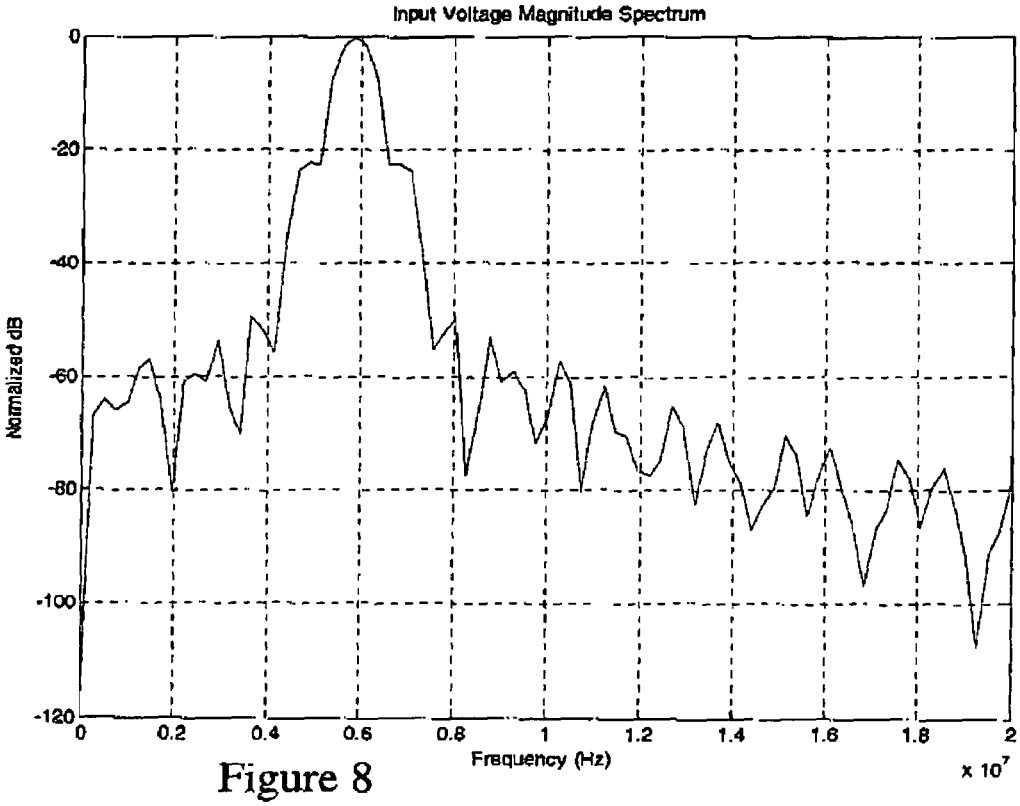
FIG. 8 is a graphical representation of a spectral response of the transmit waveform of FIG. 7.

FIG. 7 shows an example AC drive voltage signal, $V_{ac}$. The signal is a Gaussian shaped sinusoidal signal, but may have other envelopes, carriers (e.g., bipolar or unipolar square wave), and/or number of cycles. FIG. 8 shows the spectrum of the signal of FIG. 7. This voltage signal has most of its frequency content centered around 5.9 MHz, and very little harmonic content between 11 MHz and 12 MHz.

Figure 9:
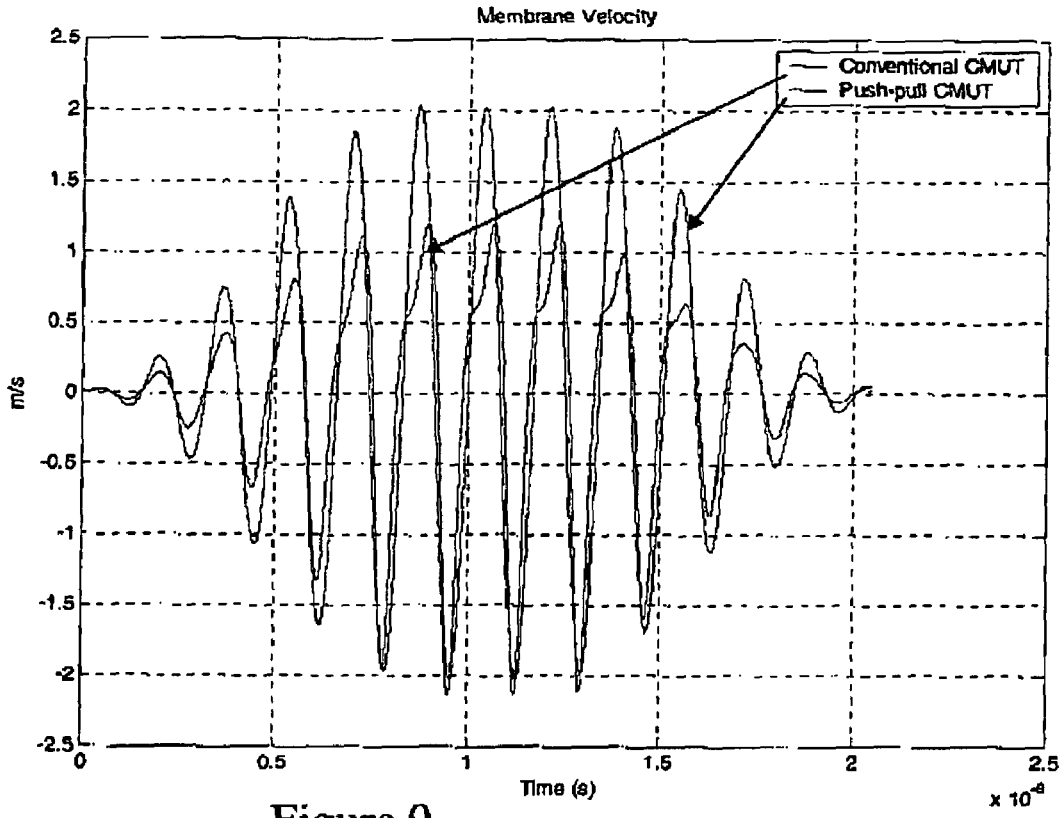
FIG. 9 is a graphical representation showing an example difference in membrane velocity between a push-pull electrostatic transducer and a single gap electrostatic transducer.

The AC drive voltage signal is applied to the membrane 12 for the signal gap CMUT and to the fixed electrodes in opposite polarity of the push-pull transducer. The output pressure is roughly proportional to the membrane velocity. The membrane velocity is determined through solution of the respective equations in the single gap and push-pull drive cases. FIG. 9 shows the membrane velocity for the push-pull and single gap CMUTs. Because the CMUT is driven at half the frequency of natural resonance, the second-order nonlinearity is accentuated by the single gap CMUT, and the velocity waveform appears distorted (see the positive peaks of the single gap, conventional CMUT).

Figure 10:
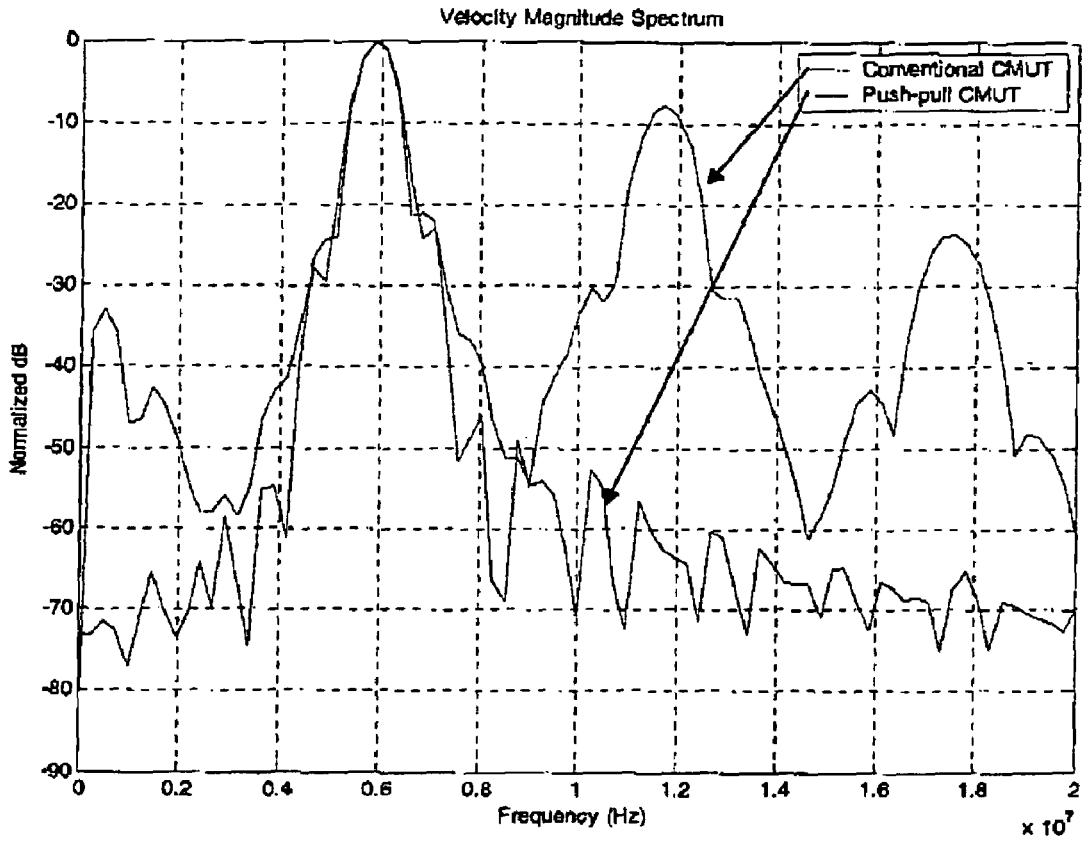
FIG. 10 is a graphical representation of the spectral responses associated with the membrane velocities and transducers of FIG. 9.

FIG. 10 shows the spectra for the velocity waveforms of FIG. 9. The harmonic content of the membrane velocity is different. The spectral peak of each transducer's velocity spectrum is normalized to 0 dB. The harmonic content of the push-pull transducer is more than 50 dB lower (similar to the levels of the input signal) than the harmonic content of the fundamental driving frequency. However, the single gap, conventional CMUT shows nonlinearities that are less than 10 dB down from the fundamental. The second order harmonic distortion caused by the transducer may be less or almost completely eliminated through push-pull operation.

Figure 11:
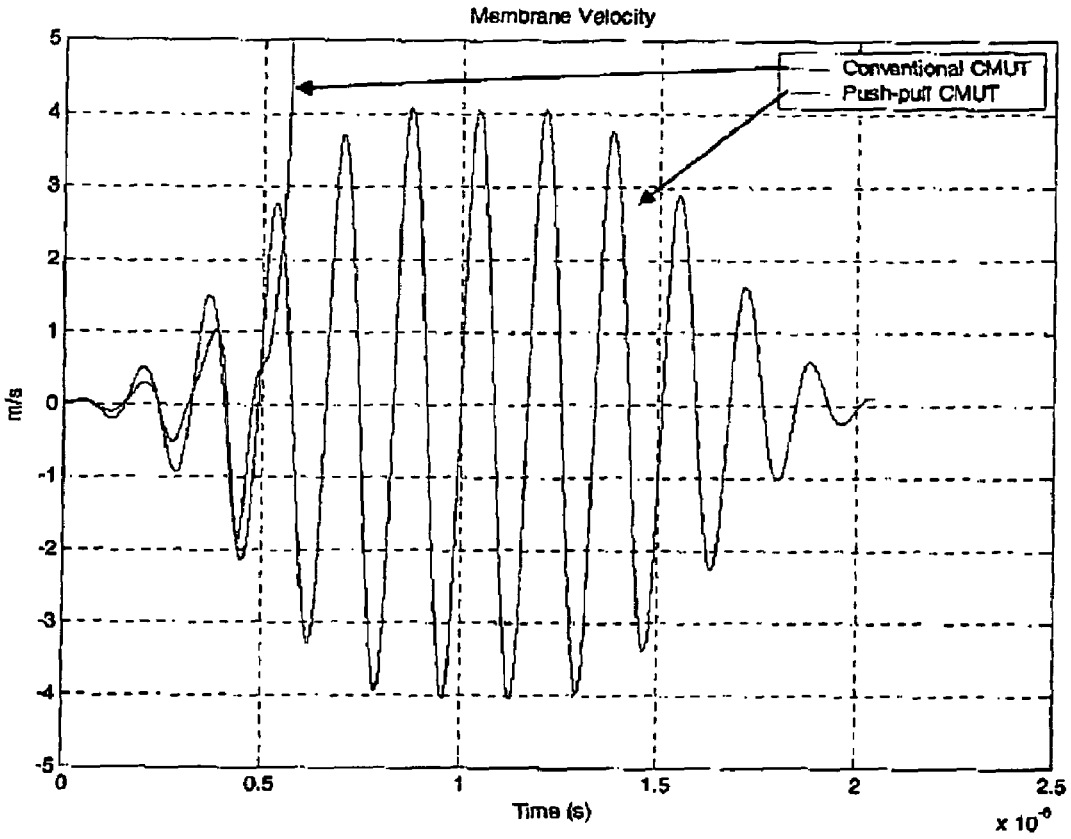
FIG. 11 is a graphical representation of exemplary membrane velocity for a push-pull electrostatic transducer and a single gap electrostatic transducer with a voltage associated with collapse of the single gap electrostatic transducer.

FIG. 11 shows another advantage of the push-pull arrangement. Larger voltages may be applied for push-pull operation. The larger voltages may collapse the single gap CMUT, but not the push-pull CMUT. For example, the AC amplitude of the driving signal is increased from 100 V to 200 V. Once the envelope reaches a threshold voltage, the single gap CMUT collapses, as represented by the membrane velocity extending off the graph. The membrane movement becomes out-of-phase with the AC signal due to collapse. The push-pull transducer may still operate, and the membrane velocity is approximately doubled. The push-pull CMUT may also collapse for even higher voltages.

In another embodiment, the membrane electrode 22 extends into or on the top surface 32. Separate electrodes at the same or different potential may be used. The substrate electrode 24 is positioned on the beam or disk 34 structure opposite the electrode 20 (e.g., the electrode 20 on the bottom and the electrode 24 on the top). The electrode 20 is adjacent to the membrane 12 across a first gap, and the electrode 24 is adjacent the top surface 32 across a second gap. Adjacent is used for relative description and may include intervening structures. The AC signals are applied to the membrane electrode 22, and the electrodes 20, 24 on the structure of the beam or disk 34 have opposite polarity DC potential. The AC signal may be applied to the membrane electrode 22 in an alternative embodiment. This structure may operate in push-pull because the electrostatic forces operate in opposite directions on the overall moving structure (i.e., the membrane 12, the top surface 32 and the pillar 30). The electrostatic forces are applied to different parts of the moving structure. Since the forces on either side of the structure of the beam or disk 34 are opposite each other, there may be less tendency to bend or deflect compared to the structure of FIG. 3. The upper electrode 24 on the structure of the beam or disk 34 and the membrane electrode 22 on the top surface 32 may be used for a "receive" operation without push-pull, and all the electrodes 20, 22, 24 may be used as a push-pull CMUT.

While the invention has been described above by reference to various embodiments, it should be understood that many changes and modifications can be made without departing from the scope of the invention. For example, the invention could find application in any electrostatic acoustic sensor, particularly in applications where a reduction in nonlinear distortion is desirable.

It is therefore intended that the foregoing detailed description be regarded as illustrative rather than limiting, and that it be understood that it is the following claims, including all equivalents, that are intended to define the spirit and scope of this invention.

We claim:

1. A capacitive micro-machined ultrasound transducer element, the element comprising:
- a membrane operable to move at ultrasound frequencies;
- a substrate, the membrane formed on or in the substrate by micro-machining the substrate using a semiconductor process;
- a first electrode associated with the membrane;
- a first gap on a first side of the membrane;
- a second electrode opposite the first gap from the membrane;
- a second gap on a second side of the membrane, the second side opposite the first side of the membrane; and
- a third electrode opposite the second gap from the membrane;
- wherein the membrane is operable to move in a direction substantially parallel to a direction of acoustic propagation generated by flexing of the membrane and operable to move in the direction because of acoustic reflections received at the membrane.

2. The element of claim 1 further comprises a plurality of additional membranes and electrodes electrically connected in parallel.

3. The element of claim 1 further comprising:
- at least one pillar extending from the membrane; and
- a top surface connected with the at least one pillar.

4. The element of claim 3 wherein the membrane, the at least one pillar and the top surface comprise an I-beam structure in an elevation, depth cross-section.

5. The element of claim 3 wherein the top surface connects with a substrate.

6. The element of claim 3 wherein the membrane connects with a substrate.

7. The element of claim 3 further comprising a structure relatively fixed as compared to the membrane, the structure connected with the second electrode and between the membrane and the top surface, the at least one pillar extending through the structure.

8. The element of claim 3 further comprising:
- additional membranes between pairs of gaps; and
- additional pillars interconnecting the additional membranes and the membrane.

9. A capacitive micro-machined ultrasound transducer element, the element comprising:
- a membrane operable to move at ultrasound frequencies;
- a first electrode associated with the membrane;
- a first gap on a first side of the membrane;
- a second electrode opposite the first gap from the membrane;
- a second gap on a second side of the membrane, the second side opposite the first side of the membrane;
- a third electrode opposite the second gap from the membrane;

wherein the membrane is operable to move in a direction substantially parallel to a direction of acoustic propagation generated by flexing of the membrane;
- a structure relatively fixed as compared to the membrane, the structure connected with the second electrode; and
- a substrate connected with the structure and connected with the third electrode.

10. The element of claim 9 wherein the structure comprises at least one stiffening rib.

11. The element of claim 1 wherein the membrane connects with a surface exposable to an acoustic medium, the surface operable to move in response to the flex of the membrane.

12. A capacitive micro-machined ultrasound transducer element, the element comprising:
- a membrane operable to move at ultrasound frequencies;
- a first electrode associated with the membrane;
- a first gap on a first side of the membrane;
- a second electrode opposite the first gap from the membrane;
- a second gap on a second side of the membrane, the second side opposite the first side of the membrane;
- a third electrode opposite the second gap from the membrane;

wherein the membrane is operable to move in a direction substantially parallel to a direction of acoustic propagation generated by flexing of the membrane;
- at least one pillar extending from the membrane; and
- a top surface connected with the at least one pillar, the top surface moveable with the membrane due to the pillar extending from the membrane and connecting with the top surface.

13. The element of claim 12 wherein the membrane, the at least one pillar and the top surface comprise an I-beam structure in an elevation, depth cross-section.

14. The element of claim 12 wherein the top surface connects with a substrate.

15. The element of claim 12 wherein the membrane connects with a substrate.

16. The element of claim 12 further comprising a structure relatively fixed as compared to the membrane, the structure connected with the second electrode and between the membrane and the top surface, the at least one pillar extending through the structure.

17. The element of claim 12 further comprising:
- additional membranes between pairs of gaps; and
- additional pillars interconnecting the additional membranes and the membrane.

* * * * *